US005729973A

United States Patent [19]

Zander et al.

[11] Patent Number: 5,729,973

[45] Date of Patent: Mar. 24, 1998

[54] EXHAUST COLLECTOR WITH PRIMARY TUBE

[75] Inventors: Lennarth Zander, Mölndal; Olof Norblad, Göteborg, both of Sweden

[73] Assignee: AB Volvo, Göteborg, Sweden

[21] Appl. No.: 583,015

[22] PCT Filed: Jul. 13, 1994

[86] PCT No.: PCT/SE94/00688

§ 371 Date: Jan. 19, 1996

§ 102(e) Date: Jan. 19, 1996

[87] PCT Pub. No.: WO95/03481

PCT Pub. Date: Feb. 2, 1995

[30] Foreign Application Priority Data

Jul. 20, 1993 [SE] Sweden ..... 9302456

[51] Int. Cl.[6] ..... F01N 7/10

[52] U.S. Cl. ..... 60/302; 60/313; 60/323

[58] Field of Search ..... 60/302, 313, 323

[56] References Cited

U.S. PATENT DOCUMENTS

| | | | |
|---|---|---|---|
| 3,791,144 | 2/1974 | Lang | 60/302 |
| 3,927,525 | 12/1975 | Jacobs | 60/302 |
| 5,293,744 | 3/1994 | Imagawa | 60/302 |

FOREIGN PATENT DOCUMENTS

| | | | |
|---|---|---|---|
| 28 17 147 | 10/1979 | Germany . | |
| 39 25 802 | 2/1991 | Germany . | |
| 41 27 633 | 2/1993 | Germany . | |
| 3057813 | 3/1991 | Japan | 60/313 |
| 88/09431 | 12/1988 | WIPO . | |

*Primary Examiner*—Douglas Hart

*Attorney, Agent, or Firm*—Burns, Doane, Swecker & Mathis, L.L.P.

[57] ABSTRACT

An exhaust collector for collecting exhaust gases from a multiple cylinder combustion engine to a common flow includes primary tubes. To reduce mass and heat losses in the exhaust system, the peripheral walls of the collector are at least to a substantial part formed by the primary tubes.

13 Claims, 2 Drawing Sheets

EXHAUST COLLECTOR WITH PRIMARY TUBE

TECHNICAL FIELD

The present invention refers to an exhaust collector with primary tubes for collecting exhaust gases from a multiple cylinder combustion engine of the piston-type to a common flow.

BACKGROUND OF THE INVENTION

The most important component in the system for purifying an exhaust gas of a combustion engine is the three-way catalytic converter. It has to convert nitrogen oxides, hydrocarbons and carbon monoxide into nitrogen, water and carbon dioxide. This conversion does not start before the catalytic converter has reached its working temperature of approximately 300° C. To ensure a quick start of the catalytic converter, it is usually placed as near as possible to the engine, considering that it should not be damaged by too high temperatures or gas speeds. This implies that the length of the exhaust tubes between the engine exhaust ports and the exhaust tube collector becomes relatively short.

Through these considerations of the catalytic converter working conditions, it is not possible to optimize the length of the exhaust pipes to exploit a decompression wave of the first order, so that the engine output ratio can be adapted to a suitable range of power and revolutions. If the primary tubes are made as long as desired, this can lead to that it takes an unacceptable long time before the catalytic converter reaches its working temperature. The primary reason why it takes such a long time is the large pipe wall mass and heat exposed surface that must be heated during cold starting.

The demands for a catalytic purification of combustion engines to function optimally within a broad working range has led to different kinds of added equipment being tested for the catalytic converter to reach up to a full working temperature within a reasonable time, specially during cool weather and when the engine is run on low strain.

Consequently, it is known to achieve a reduction of the exhaust dumping at cold starting by using two tandem coupled catalytic converters, one of which is comparatively small and therefore can be warmed up quickly. When the exhaust gases have acquired their normal working temperature, a switching is done from the start converter to the main catalytic converter. Different variants of systems with start and main catalytic converters are known, for example through U.S. Pat. No. 3,44,817, U.S. Pat. No. 4,444,012 and U.S. Pat. No. 4,817,385.

SE 9101125-4 further shows a system where the catalytic converter and the exhaust silencer are dimensioned for low strain. If an increased exhaust resistance is detected, which occurs during a transfer to a higher performance range, a passage past the catalytic converter is opened by means of a valve and the exhaust system is adapted for the high performance area.

However, the solutions described above, using a start and a main catalytic converter as well as valves for switching from one control mode to another, imply price rises and risks for function disturbances in the exhaust purification system.

OBJECT OF THE INVENTION

One object of the present invention is therefore to produce an exhaust collector with primary tubes that is long enough to be able to exploit gas dynamic effects, without the collector system becoming space and material consuming, heavy and prone to extending the warm-up time of the catalytic converter to working temperature.

SUMMARY OF THE INVENTION

This object is achieved, according to the invention, in that the primary tubes are tangentially wound around the collector, and that the primary tube walls nearest to the collector, at least to a substantial part form the peripheral walls of the collector. By having the primary tubes integrated with the collector in this way, the tubes may be given a length advantageous for gas dynamics, without having to take complicated measures to reduce the time that is needed before a catalytic converter connected to the collector system reaches its working temperature.

According to an advantageous variant of the invention, the collector forms an oblong cylindrical chamber to which the primary tubes are mainly tangentially connected. Through this design, the exhaust gases come tangentially into the collector and are turned into an axial motion, which leads to a more even flow of exhaust gases to a catalytic monolith which is connected to the collector and which is thereby used more effectively.

The primary tubes can stretch in form of either a spiral or an helix around the collector. The length of the tubes is preferably such that they stretch for a distance of at least about one revolution around the collector. According to an advantageous embodiment of the invention, the primary tubes run so closely under said revolution, that the primary tubes, running against each other, are delimited by a common wall part. Through this design, the heat radiation to the surrounding is further reduced.

The primary tubes can have a length of 0.5–2.0 m and preferably present a diameter such that, within the range of revolutions of the engine, they give a back-reflected negative pressure wave to their respective exhaust valve, when overlapping occurs between exhaust and inlet valves.

The collector is preferably connected to at least one catalytic cell.

If the primary tubes have a square cross section, they can completely share the partition walls.

DETAILED DESCRIPTION OF THE DRAWING FIGURES

Figure 1:
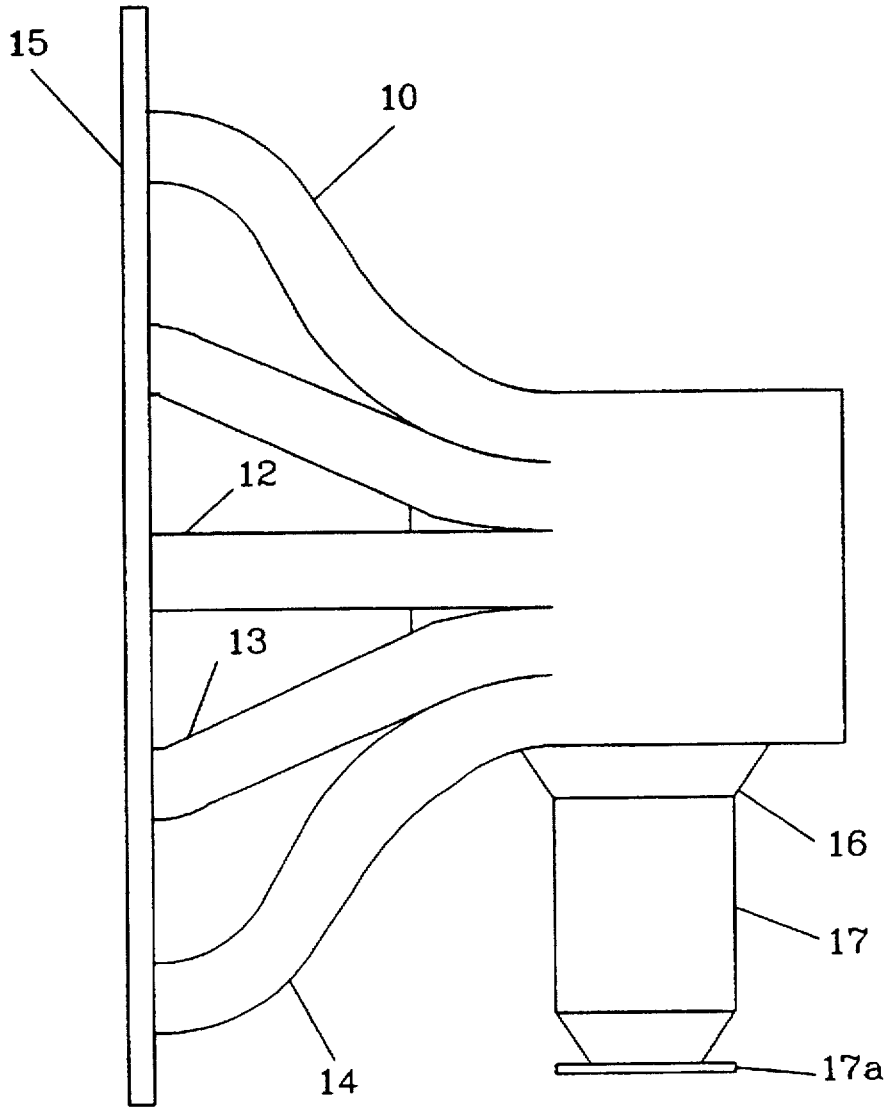
Figure 2:
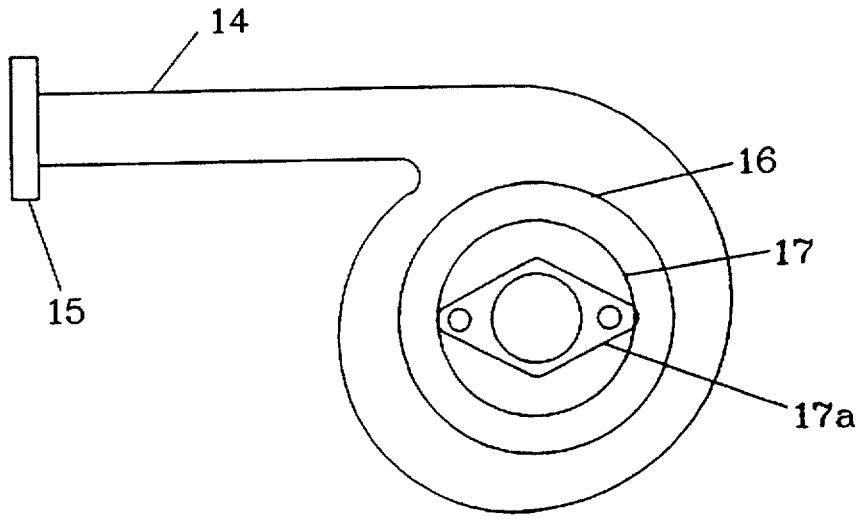
Figure 3:
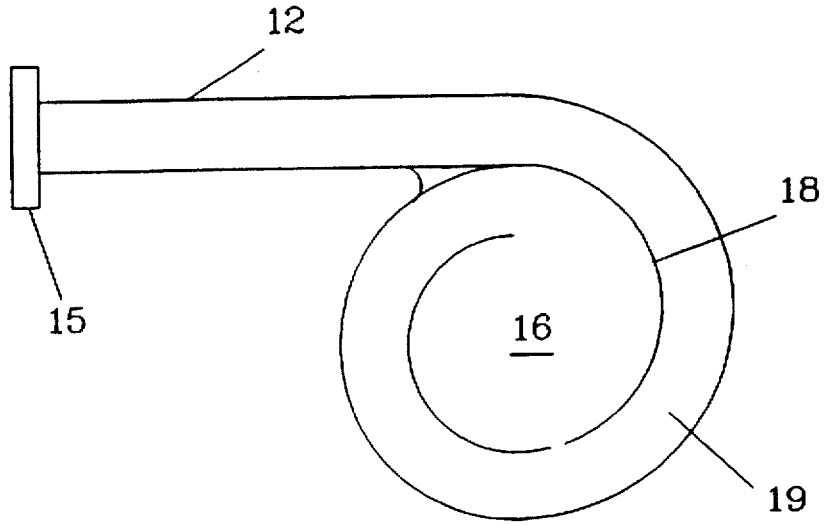

One embodiment of the invention will now be described more closely with reference to the accompanying drawings, on which FIG. 1 schematically shows an exhaust collector with primary tubes according to the invention in top view, FIG. 2 is a bottom view of the exhaust collector shown in FIG. 1, and FIG. 3 is a sectional view taken along line II—II in FIG. 1.

DETAILED DESCRIPTION OF PREFERRED EMBODIMENTS

The exhaust collector shown on the drawing is provided with five primary tubes 10–14, which are connectable by means of a common assembly flange 15 to a combustion engine, which is not shown. Other types are of course conceivable with more or fewer primary tubes.

The primary tubes extend along the shortest possible way to join the centrally located tube 12. From that point where the tubes 11 and 13 meet the tube 12 and the tubes 10 and 14 meet the respective tubes 11 and 13, the primary tubes run in parallel, until they emerge into a collector 16. The collector is oblong and extends across the longitudinal direction of the tubes, and it emerges into a catalytic converter 17 with an assembly flange 17*a* for a subsequent exhaust silencer.

Such as appearing from FIGS. 2 and 3, the primary tubes run in the manner of a spiral around the collector 16, at least about one turn, before they emerge into the collector. The diametrical inside partition walls 18 of the primary tubes can thereby cooperate to form the peripheral wall of the collector. By integrating the primary tubes and the collector in such a way, the consumption of material for producing these components is reduced. Since less material needs to be warmed up during cold starting, a catalytic converter 17 can quickly reach its working temperature. Besides, the heat radiation is reduced, as the peripheral walls of the collector do not have any contact with the comparatively cold surroundings.

According to an advantageous variant of the invention, the primary tubes have a square cross-section. This implies that the primary tubes, running against each other, can be delimited by a common wall part, and that the material for the collector system and its weight can be further reduced.

The primary tubes can run in form of either a spiral or an helix around the collector.

The invention is not limited to the embodiment described above, as many variants are conceivable within the scope of the following claims. The device according to the invention can be applied with advantage to private cars as well as trucks, buses, motorcycles and motorboats. The advantageous integration of the primary tubes and the collector can even be used for an exhaust system without catalytic converter.

What is claimed is:

1. An exhaust collector for collecting exhaust gases from a multiple cylinder combustion engine of the piston-type to a common flow, comprising a collector, a plurality of primary tubes spirally wound around the collector, and a catalytic converter connected to the collector, the primary tubes having walls nearest to the collector which at least to a substantial part form peripheral walls of the collector.

2. A collector according to claim 1, wherein said collector forms an oblong cylindrical chamber to which said primary tubes are tangentially connected.

3. A collector according to claim 2, wherein said primary tubes extend for a distance of at least about one turn around said collector.

4. A collector according to claim 3, wherein said primary tubes extend closely together along said turn so that said primary tubes run against each other, delimited by a common wall element.

5. A collector according to claim 1, wherein said primary tubes have a length of between 0.5 m–2.0 m and present a diameter such that the primary tubes provide a back-reflected negative pressure wave to their respective exhaust valve, when overlapping occurs between exhaust and inlet valves.

6. A collector according to claim 1, wherein said primary tubes have a square cross section.

7. A collector claim 2, wherein said primary tubes have a length of between 0.5 m–2.0 m and present a diameter such that the primary tubes provide a back-reflected negative pressure wave to respective exhaust valves when overlapping occurs between exhaust and inlet valves.

8. A collector according to claim 3, wherein said primary tubes have a length of between 0.5 m–2.0 m and present a diameter such that the primary tubes provide a back-reflected negative pressure wave to respective exhaust valves when overlapping occurs between exhaust and inlet valves.

9. An exhaust collector device for collecting exhaust gases from a multiple cylinder combustion engine to a common flow, comprising a collector, a plurality of primary tubes extending spirally around the collector, said primary tubes having inside walls that form at least in part a peripheral wall of the collector.

10. An exhaust collector device according to claim 9, wherein said primary tubes are connected to a common flange.

11. A collector according to claim 9, wherein said collector is connected to at least one catalytic cell.

12. A collector according to claim 9, wherein primary tubes extend for a distance of at least about one turn around said collector.

13. A collector according to claim 12, wherein said primary tubes have a length of between 0.5 m–2.0 m and present a diameter such that the primary tubes provide a back-reflected negative pressure wave to respective exhaust valves when overlapping occurs between exhaust and inlet valves.

* * * * *